US011473313B2

(12) United States Patent
Koetje

(10) Patent No.: US 11,473,313 B2
(45) **Date of Patent: *Oct. 18, 2022**

(54) FORM PANEL SYSTEM

(71) Applicant: Timothy Koetje, Lynden, WA (US)

(72) Inventor: Timothy Koetje, Lynden, WA (US)

(73) Assignee: Axiom Construction And Consulting LLC, Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/081,884

(22) Filed: Oct. 27, 2020

(65) Prior Publication Data

US 2021/0040745 A1 Feb. 11, 2021

Related U.S. Application Data

(63) Continuation of application No. 16/451,892, filed on Jun. 25, 2019, now Pat. No. 10,815,671, which is a continuation of application No. 15/649,537, filed on Jul. 13, 2017, now Pat. No. 10,329,774.

(60) Provisional application No. 62/362,479, filed on Jul. 14, 2016.

(51) Int. Cl.
*E04B 2/00* (2006.01)
*E04F 13/08* (2006.01)

(52) U.S. Cl.
CPC ..... *E04F 13/0835* (2013.01); *E04F 13/0851* (2013.01); *E04F 13/0889* (2013.01); *E04F 13/0891* (2013.01); *E04F 2201/05* (2013.01)

(58) Field of Classification Search
CPC ..... E04F 13/0889; E04F 2201/05; E04F 13/0835; E04B 9/26
USPC ..... 52/506.09
See application file for complete search history.

(56) References Cited

U.S. PATENT DOCUMENTS

| | | | | |
|---|---|---|---|---|
| 4,685,263 | A * | 8/1987 | Ting | E04B 2/92 52/235 |
| 5,226,274 | A | 7/1993 | Sommerstein | |
| 5,452,552 | A | 9/1995 | Ting | |
| 5,803,424 | A | 9/1998 | Keehn et al. | |
| 6,581,354 | B1 | 6/2003 | Skarpness | |
| 7,562,504 | B2 | 7/2009 | Herbst et al. | |
| 8,127,507 | B1 | 3/2012 | Bilge | |
| 8,973,739 | B2 | 3/2015 | Zieger | |
| 9,091,079 | B2 | 7/2015 | Wright | |
| 9,359,772 | B2 | 6/2016 | Prica et al. | |
| 9,482,006 | B2 | 11/2016 | Koetje | |
| 9,527,672 | B2 | 12/2016 | Batchelder et al. | |

(Continued)

FOREIGN PATENT DOCUMENTS

CA 2869480 A1 5/2015

OTHER PUBLICATIONS

NOORDA, Noorda.com, "3D Exposed Fastener WP" drawing, predates Jul. 14, 2016, 1 page.

(Continued)

*Primary Examiner* — Basil S Katcheves
(74) *Attorney, Agent, or Firm* — Schacht Law Office, Inc.; Dwayne Rogge

(57) ABSTRACT

This application relates to the field of reveal architectural panel assemblies. The apparatus replaces prior art assembly methods and fasteners with a particular connecting structure to facilitate assembly. The frame extrusions are modified to facilitate assembly and increase ease in adaptation and installation.

6 Claims, 7 Drawing Sheets

(56) References Cited

U.S. PATENT DOCUMENTS

| | | | | |
|---|---|---|---|---|
| 9,803,372 | B2 | 10/2017 | Griffiths et al. | |
| 9,850,666 | B2 | 12/2017 | Libreiro et al. | |
| 9,914,591 | B2 | 3/2018 | DeGroot et al. | |
| 10,208,484 | B1 | 2/2019 | Simonsen | |
| 10,213,905 | B2 | 2/2019 | Koetje | |
| 10,329,774 | B2 | 6/2019 | Koetje | |
| 10,675,737 | B2 | 6/2020 | Koetje | |
| 10,815,671 | B2 * | 10/2020 | Koetje | E04F 13/0851 |
| 10,865,569 | B1 | 12/2020 | Bilge | |
| 10,967,486 | B2 | 4/2021 | Koetje | |
| 2002/0124514 | A1 | 9/2002 | Higgins | |
| 2002/0152704 | A1 | 10/2002 | Thompson et al. | |
| 2007/0022682 | A1 | 2/2007 | Morgenegg et al. | |
| 2009/0241451 | A1 | 10/2009 | Griffiths | |
| 2010/0037549 | A1 | 2/2010 | Lynch et al. | |
| 2012/0017530 | A1 | 1/2012 | Hummel | |
| 2012/0096799 | A1 | 4/2012 | Wright | |
| 2013/0118107 | A1 | 5/2013 | Maday et al. | |
| 2015/0121794 | A1 | 5/2015 | Koetje | |
| 2015/0300027 | A1 | 10/2015 | Day et al. | |
| 2015/0345152 | A1 | 12/2015 | Libreiro et al. | |
| 2017/0021475 | A1 | 1/2017 | Koetje | |
| 2019/0184527 | A1 | 6/2019 | Koetje | |

OTHER PUBLICATIONS

NOORDA, Noorda.com, "3D NWT 1000" drawing, predates Jul. 14, 2016, 1 page.

Omega Panel Products, Laminators Inc. Product Technical Guide, Aluminum Composite Panels & Installation Systems; Jun. 2012, 16 pages.

Sobotec Architectural Wall System Solutions; SL-3000 Dry Joint Gasketed Extrusion System, Nov. 1, 2013, 1 page.

* cited by examiner

FORM PANEL SYSTEM

RELATED APPLICATIONS

This application is a continuation of U.S. Ser. No. 16/451,892 filed Jun. 25, 2019, which is a continuation of U.S. Ser. No. 15/649,537 filed Jul. 13, 2017, which claims priority benefit of U.S. Provisional Ser. No. 62/362,479 filed Jul. 14, 2016, each incorporated herein by reference.

BACKGROUND OF THE DISCLOSURE

This application relates to the field of reveal architectural panels, several examples of which are disclosed.

DETAILED DESCRIPTION OF THE DISCLOSURE

Figure 2:
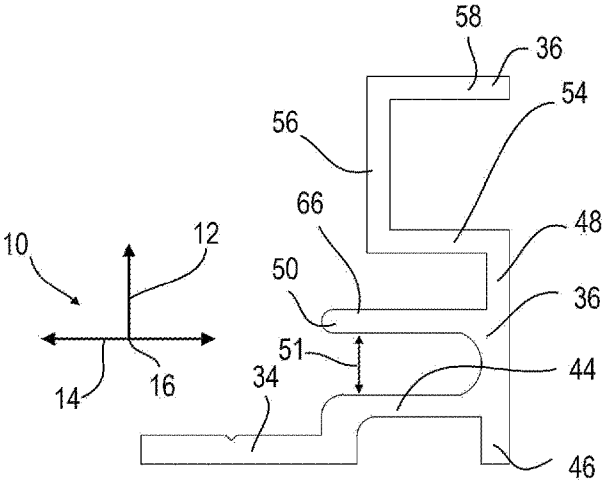
FIG. 2 is a cross sectional view of one example of a mounting extrusion component of the disclosed form panel system.

Disclosed herein is a novel composite architectural face panel assembly, shown in several examples. Interoperating wall attachment extrusions are disclosed for different installations as required by the installation desired, location of adjacent obstructions, and ease in installation. The term extrusions intended to include components that may be formed by methods of extrusion, molding, machining, etc. and not limited to an extrusion production method.

The disclosed architectural face panel assembly 20 overcomes many of the installation, sealing, weather resistance, aesthetic appeal, and structural integrity issues of prior art examples. Many of which required additional sealants between adjacent outer panels, or required visible fasteners. The combination uses three main components being a mounting extrusion frame component, an insert extrusion component, and an outer panel affixed to mounting extrusions and/or insert extrusions, commonly around the perimeter thereof. The mounting extrusion component(s) and insert extrusion component(s) may be combined and affixed in various orientations to form a perimeter frame for the outer panel. One significant benefit of this is that with only two extrusion components, a wide variety of mounting arrangements may be achieved. Various surfaces of the mounting extrusion component(s) and insert extrusion component(s) may be used to affix the outer panel to the frame.

Before continuing a detailed description, an axes system 10 is shown (FIG. 2) including a transverse axis 12, and lateral axis 14. A longitudinal axis 16 is also defined as orthogonal to the transverse axis 12, and lateral axis 14.

Figure 7:
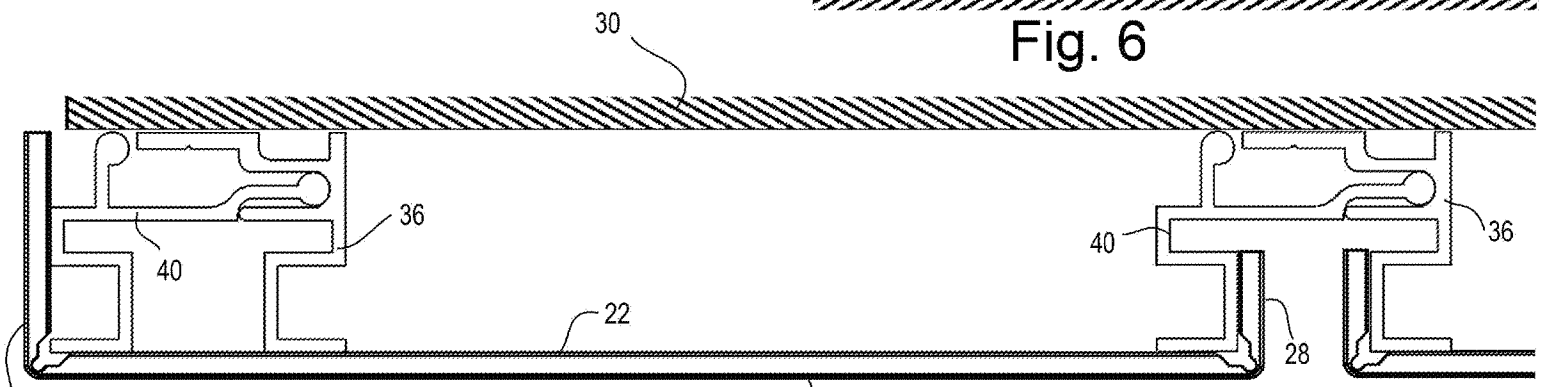
FIG. 7 is a cross sectional view of another example of the components shown in FIG. 3, also showing outer panels attached thereto.

Disclosed herein is an architectural panel assembly 20 (specific examples are labeled as 20*a*-20*s*) which as shown in the specific example of FIG. 7 comprises an outer panel 22. The edges of the outer panel 22 may be bent or folded so as to form a face panel 24 with opposing side panels 26 and 28. In most applications, top panels and bottom panels substantially equivalent to the side panels 26 and 28 will be formed. Such an outer panel 22 is then attached to one or more extrusions as will be described in more detail. Once installed, one or more of the panel extrusions are then attached to a building surface 30 which is most commonly the exterior wall of a building although it may alternatively be a floor, interior wall, ceiling, roof, door, etc.

Figure 4:
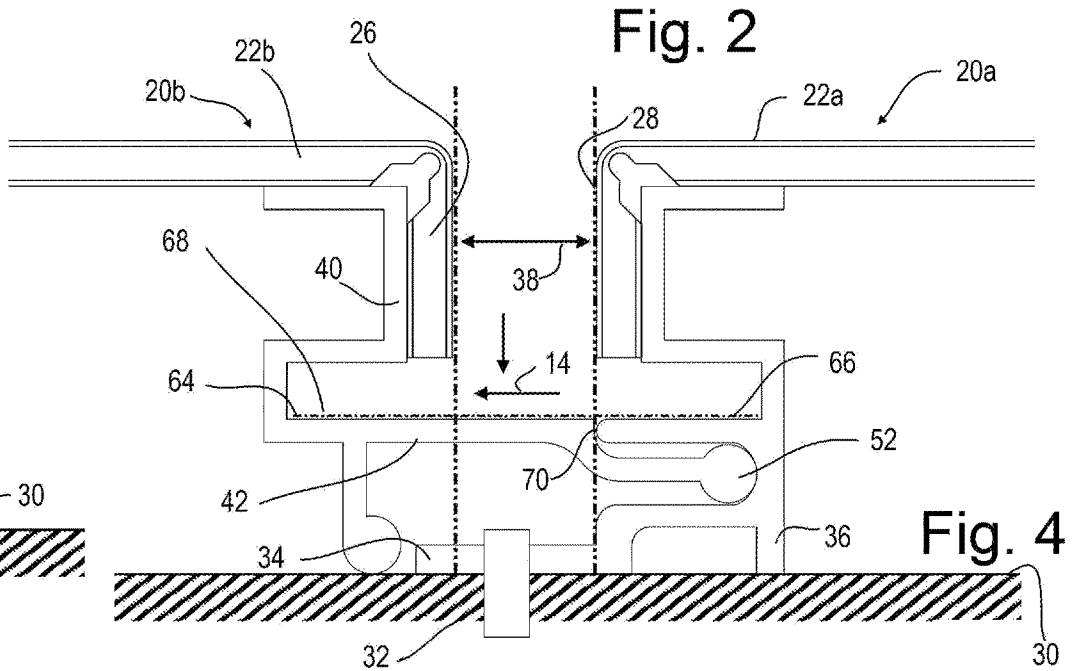
FIG. 4 is a cross sectional view of one example of the components of FIG. 3 also showing outer panels attached thereto.
Figure 1:
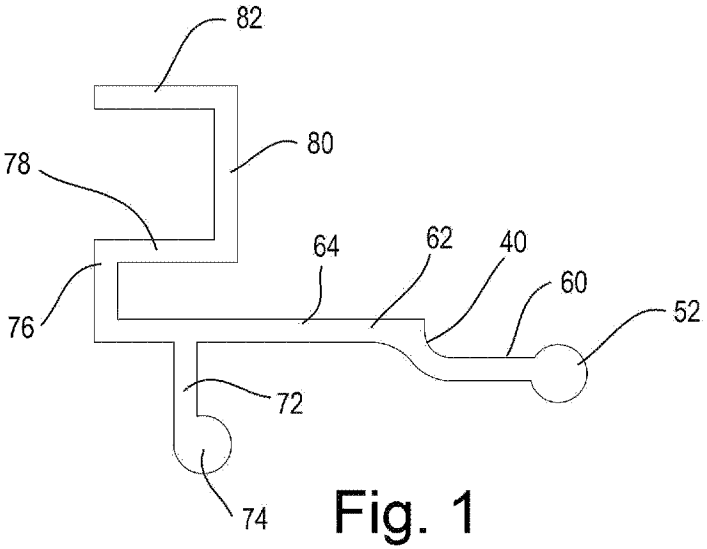
FIG. 1 is a cross sectional view of one example of an insert extrusion component of the disclosed form panel system.

Looking to FIG. 4 is shown one such example wherein a first panel assembly 20*a* has been attached to a building surface 30. In this example a fastener 32 passes through an extending portion 34 of a (female) wall mounting extrusion 36. Prior to installation of the adjoining extrusion, the fastener 32 can be easily installed, as the fastener 32 is not overlapped by the outer panel 22. Other examples of the fastener 32 are shown in FIGS. 8-15. Once the first panel assembly 20*a* is attached to the building surface 30, a second panel assembly 20*b* is attached directly to the mounting extrusion 36 by way of a (male) insert extrusion 40 in a manner which will be described in more detail. In this position, a gap 38 remains between the side panel 26 of the second panel assembly 20*b* and the side panel 28 of the first panel assembly 20*a*. This gap 38 is aesthetically important and it will often be desired to maintain this gap 38 at substantially the same width across the entire installation. In some examples, a longer fastener may then pass through both an extension 42 of the insert extrusion 40, and the extension 34 of the wall mounting extrusion 36 at a different position along the gap 38. In many applications, such a second fastener will not be desired, as it may be visually observed through the gap 38 and a clean/uninterrupted look will be desired.

To further facilitate a clean look to the outer surface of the installed panel assemblies 20, without the application of rigid fasteners such as rivets, screws, or other mechanical fasteners passing through the outer panel 22, reducing aesthetic appeal and potentially allowing a fluid conduit, the attachment system between the frame of the extrusions 36 and 40 to the outer panel 22 as disclosed in U.S. patent application Ser. No. 14/531,054 ('054) filed on Nov. 3, 2014, and incorporated herein by reference may be utilized. Such attachment system utilizes adhesives between the extrusion components and the outer panel rather than rigid fasteners. Although in many other applications, adhesives and fasteners are known to one of ordinary skill in the art to be interchangeable, testing of prior adhered panel assemblies with outer panels and rigid frames were previously not functional over time due to the wind shear effects and heat expansion affects encountered in installations where the adhesive failed to secure the outer panel to the frame. The '054 disclosure overcomes prior problems with assembly of these panel assemblies without mechanical fasteners.

Looking to FIG. 2 it can be seen an example wherein the mounting extrusion 36 comprises the extending portion 34. The extending portion 34 may be attached to an arch extension 44 portion of the mounting extrusion 36. The arch extension 44 in one example having a short foot 46 extending which contacts the building surface 30 and in some applications provides additional rigidity and support to the panel assembly 20. Extending transversely outward 12 from the arch extension 44 is a transverse extension 48 having a lateral extension 50 substantially parallel to the arch extension 44 and adjacent thereto so as to fit a transversely expanded end 52 of the insert extrusion 40 there between. The transversely expanded end 52 in one example is transversely larger than the lateral extension (protrusion) 60 and may be substantially cylindrical, or circular in cross section. In one example the transversely expanded end 52 will press fit between the lateral extension 50 and the arch extension 44 so as to form a fluid (liquid and/or gas) seal. The expanded end 52 allows for insertion and sealing of the lateral extension 60 into the gap 51, including in an installation when the lateral extension 60 is not perfectly aligned with the gap 51. Variances in the building surface 30 from a plane are easily overcome, and installation is simplified when perfect alignment is not required.

Another lateral extension 54 of the mounting extrusion 36 may extend from the transverse extension 48 with a transverse attachment surface 56 extending therefrom and optionally a lateral attachment surface 58 extending therefrom. The side panel(s) 26/28 may then be attached to the frame components/extrusions 36/40 etc. by way of an adhesive, fastener, welding, brazing, etc. to the transverse attachment surface 56. Similarly, the face panel 24 may be attached to the lateral attachment surface 58.

Similarly, a lateral extension 60 of the insert extrusion 40 of one example comprises the expanded end 52 which is attached to or formed as a part of the lateral end of a lateral extension 60. The lateral extension 60 in one example is offset in the transverse direction 12 from a lateral extension 62 so as to be easily inserted into the gap 51 between the lateral extension 50 and the arch extension 44. The lateral extension 62 in one example has an outward surface 64 which may be substantially planar with the surface 66 of the lateral extension 50 previously disclosed. Thus, looking to FIG. 4 it can be seen that these two surfaces 64 and 66 lie in the same plane 68 and thus in combination are more aesthetically pleasing to a viewer than prior art assemblies with offset surfaces. This planar surface 68 in combination with a tight seal around the expanded end 52 in one example fits snugly between the extension 50 and extension 44, forming a seal. In addition, in one example the lateral extension 62 inward of lateral extension 60 contacts the lateral extension 50 at point of contact 70. In one example this arrangement of contact surfaces does not require the use of compressive seals generally utilized in the prior art such as the NWT 1000 installation. Our testing has shown that such flexible seals may be difficult to install and are prone to movement and failure.

Figure 3:
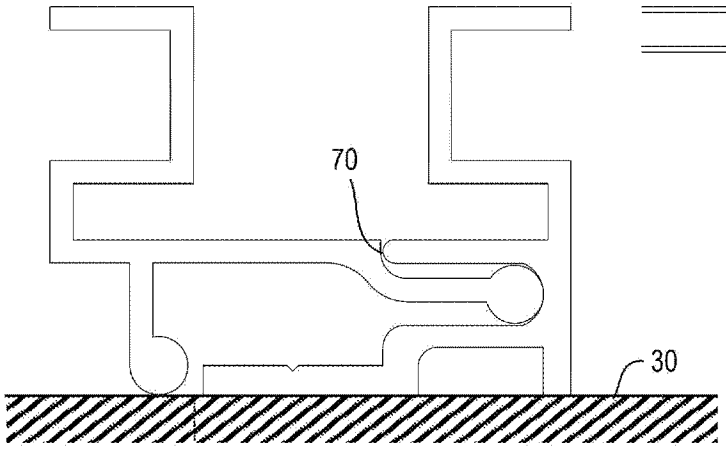
FIG. 3 is a cross sectional view of one example of the insert extrusion component coupled to the mounting extrusion component of the disclosed form panel system.

Continuing with a description of the insert extrusion 40, a transverse extension 72 may be attached to or formed as a part of the extension 62. The transverse extension 72 may have a similar expanded end 74 at the end thereof for alternate installations into the gap 51 or other gaps in a frame component. In several examples shown in FIG. 3 and FIG. 4, the transverse extension 72 extends to contact the building surface to which the adjacent mounting extrusion 36 is attached. In addition, a transverse extension 76 of the insert extrusion 40 is shown. The transverse extension 76 having a lateral extension 78 extending therefrom. Also shown is a transverse extension 80 and a lateral attachment surface 82 which are structurally mirror images of the transverse attachment surface 56 and lateral attachment surface 58 previously disclosed for attachment and sealing of the insert extrusion 40 to the outer panel 22. In the installation shown in FIG. 4, the extension 82 and extension 58 have outer surfaces that lie in substantially the same plane. This provides that the outer surfaces of adjacent panels 22*a* and 22*b* are substantially planar, creating a very aesthetically pleasing surface.

The assembly shown in FIG. 4 may provide a gap 38 between adjacent panels 22*a* and 22*b*. Generally, for use in installation of one panel assembly 20 vertically adjacent and above another, it may be desired to positon the wall mounting extension 36 such that the expanded end receiver 84 defined by the gap 51 formed between the arch extension 44 and lateral extension 50 as previously disclosed is facing an upward direction. This provides an installation such that the adjacent outer panel 22*b* may be attached in such a manner that the transversely expanded end 52 rests within the receiver 84 as the opposing side of the outer panel 22*b* is affixed to the building surface 30, in one example by way of fasteners 32 similar to the attachment shown in FIG. 4.

Figure 5:
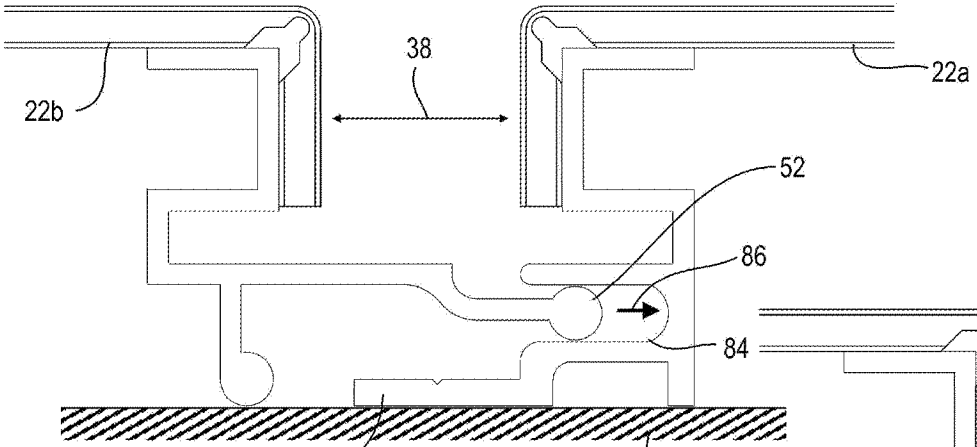
FIG. 5 is a cross sectional view of one example of the components shown in FIG. 4 in a prior assembly step than shown in FIG. 5.

Looking to FIG. 5 it can be seen that the transversely expanded end 52 is being positioned into the receiver 84 in direction of travel 86 during an installation.

Figure 6:
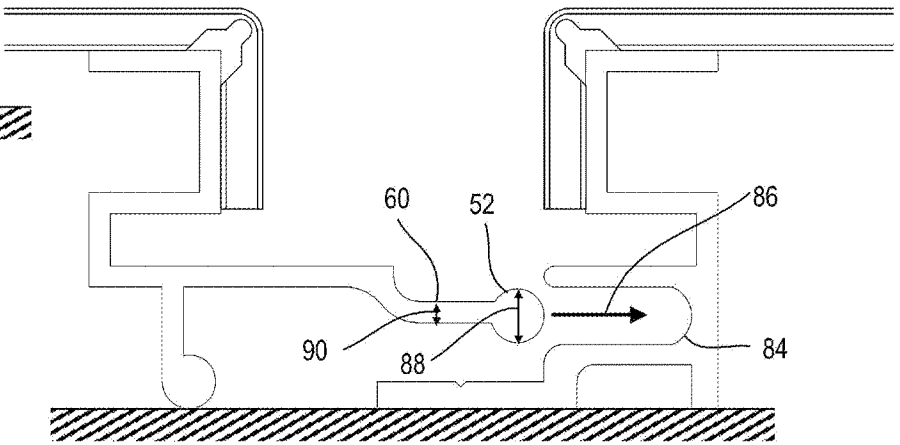
FIG. 6 is a cross sectional view of one example of the components shown in FIG. 5 in a prior assembly step than shown in FIG. 6.

Looking to FIG. 6, it can be seen an example where the transversely expanded end 52 is exterior of the receiver 84 prior to installation therein. One substantial advantage of the transversely expanded end 52 having a slightly larger diameter 88 than the adjacent width 90 of the extension 60 is that perfect alignment need not be achieved, in that some offset alignment will be permitted by this arrangement.

Looking to FIG. 7 is shown an example wherein a panel assembly 20*c* comprises (male) insert extrusions 40 on each end of the face panel 24*c* and two separate wall mounting extrusions 36. Each mounting extrusion 36 affixed to the building surface 30 prior to installation of the panel assembly 20*c*. This allows for the side panel 26*c* to extend transversely to the plane of the building surface 30 and installed with few, if any visible fasteners once installation is complete.

Figure 8:
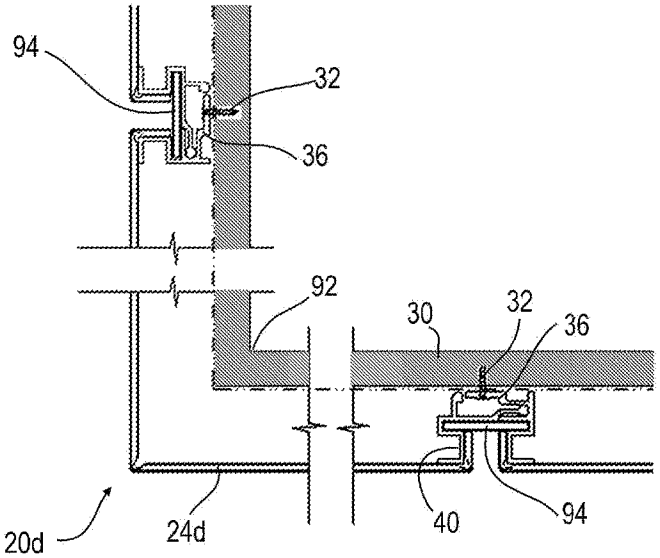
FIG. 8 is a cross sectional top view of one example of the components shown in FIG. 3 also showing outer panels attached thereto in a corner installation.

Looking to FIG. 8 is shown an example wherein the face panel 24*d* extends around a corner 92 of the building surface 30 to attach on adjacent, non-planar sides of the building. As shown, a mounting extrusion 36 is attached to one wall, and the panel assembly 20*d* extend around the corner with another mounting extrusion attached to the other wall. In addition, this example shows optional splines 94 inserted between panel assemblies. These splines change the aesthetic appeal, and may be used to improve weather protection as another barrier to water, air, and debris intrusion. These splines may be omitted as desired.

Figure 9:
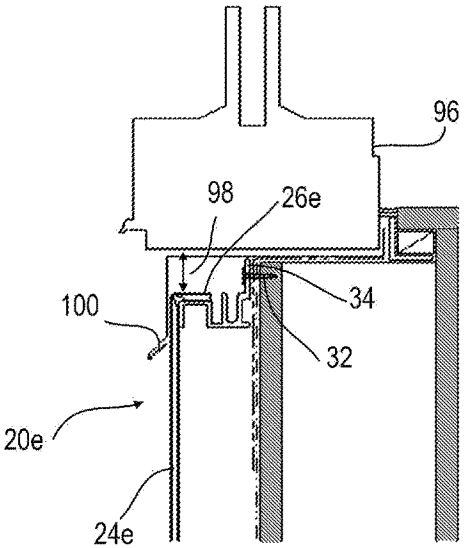
FIG. 9 is a cross sectional view of one example of the components shown in FIG. 3 also showing outer panels attached thereto adjacent an obstruction.

FIG. 9 shows an installation example where the panel assembly 20*e* is attached adjacent an obstruction 96. One substantial advantage of this installation is that the gap width 98 between the side panel 26*e* and the obstruction 96 may be substantially equivalent to the gap 38 previously disclosed for aesthetic appeal. Having gaps of equivalent width being aesthetically pleasing in many installations. In one example, the obstruction 96 will be directly adjacent the outward end of the extending portion 34 previously disclosed. Alternatively, flashing 100 may be applied for additional weather resistance.

Figure 10:
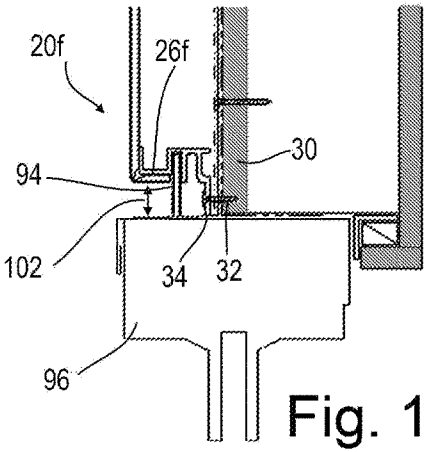
FIG. 10 is a cross sectional view of another example of the components shown in FIG. 3 also showing outer panels attached thereto adjacent an obstruction.

FIG. 10 shows another similar example wherein the panel assembly 20*f* is attached adjacent an obstruction 96 such as at the vertical bottom of a building surface 30. Again, the length of the extending portion 34 provides for the gap 102 between the side panel 26*f* and the obstruction 96 to be substantially equivalent to the gap 38 previously disclosed for aesthetic appeal. As can be clearly seen for example in FIG. 5, the extending portion 34 extends substantially the width of the gap 38 between extrusions, aiding in proper positioning of adjacent panel assemblies 20. In addition, an optional spline 94 as shown in FIG. 8 may be utilized to further obstruct this gap for aesthetics or weather sealing.

Figure 11:
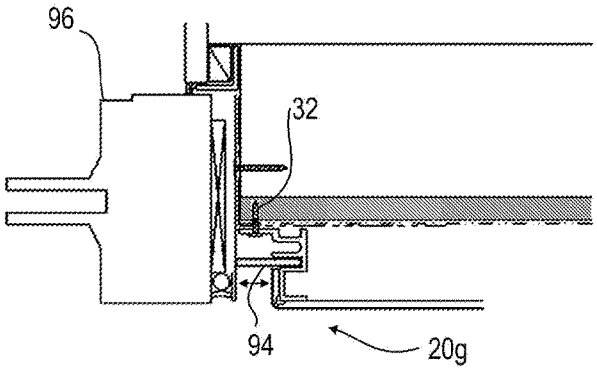
FIG. 11 is a cross sectional view of another example of the components shown in FIG. 3 also showing outer panels attached thereto adjacent an obstruction.
Figure 12:
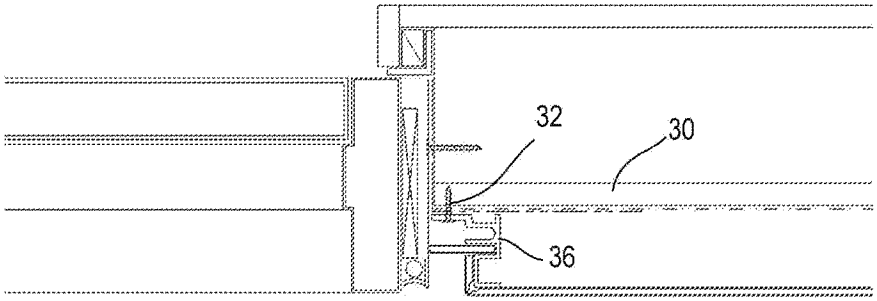
FIG. 12 is a cross sectional view of another example of the components shown in FIG. 3 also showing outer panels attached thereto adjacent an end panel.

FIG. 11 shows a similar example to that shown in FIG. 10, with a slight change in the orientation of the assembly, and with the addition of weatherproofing elements between the obstruction 96 and the panel assembly 20*g* such as may be used where the obstruction 96 is a window, doorway, sliding door, rolling door etc. A similar example is shown in FIG. 12.

Figure 13:
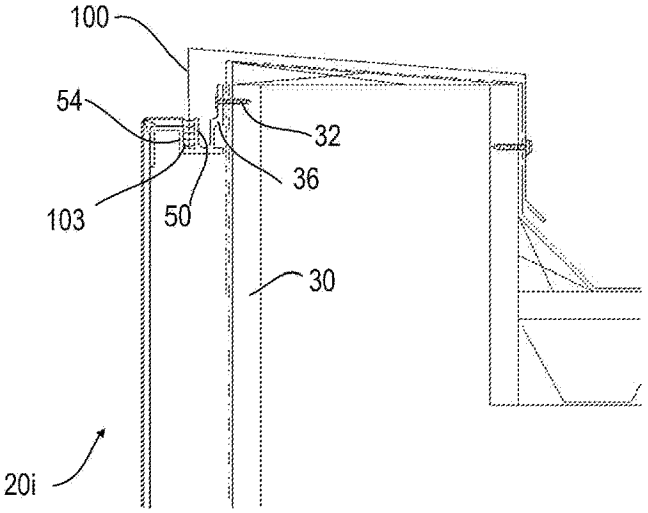
FIG. 13 is a cross sectional view of another example of the components shown in FIG. 3 also showing outer panels attached thereto adjacent an end panel.

Looking to FIG. 13 is shown another example similar in some respects to the example shown in FIG. 9. In this example, the flashing 100 is sealed to the mounting extrusion 36 via a volume of sealant 103 disposed in the region between the lateral extension 50 of the lateral extension 54 previously disclosed alternatively, sealant may be disposed in the gap 51. In this example. This example maintains a weatherproof seal between the flashing 100 and the building surface 30.

Figure 14:
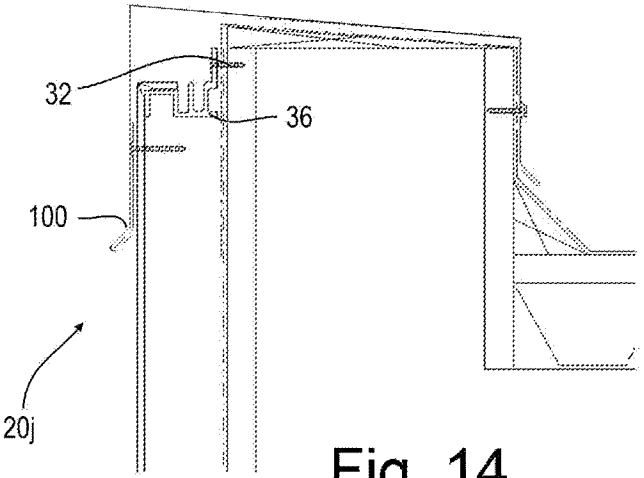
FIG. 14 is a cross sectional view of another example of the components shown in FIG. 3 also showing outer panels attached thereto on an end panel.

Alternatively, as shown in FIG. 14, the flashing may be attached over, outward of, and thus entirely protecting the mounting extrusion 36. To achieve this, fasteners may be used as shown to attach the flashing 100 to the panel assembly 20*j*.

Figure 15:
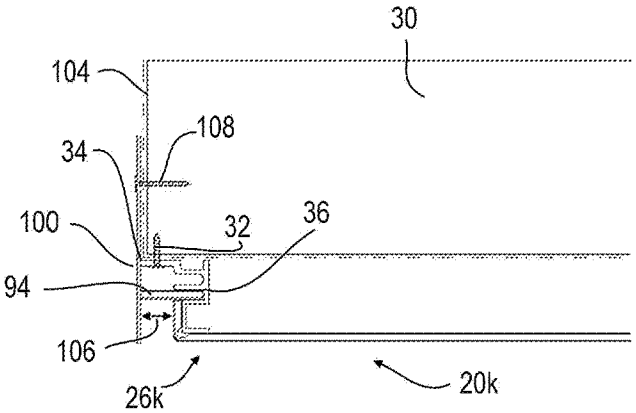
FIG. 15 is a cross sectional view of another example of the components shown in FIG. 3 also showing outer panels attached thereto on an end panel.

FIG. 15 shows another example wherein the side panel 26*k* is attached to a wall mounting extrusion 36 having an extending portion 34 which substantially extends to the end 104 of the building surface 30. The fastener 32 is easily utilized and the gap 106 between the end wall 26*k* and the surface 104 is substantially equivalent to the gap 38 previously disclosed for aesthetic appeal. Additionally, the flashing 100 utilized in this example is substantially planar and may be attached to the wall by way of a fastener 108 such as a screw. For aesthetic appeal and weatherproofing, a spline 94 as previously disclosed may be utilized.

Figure 16:
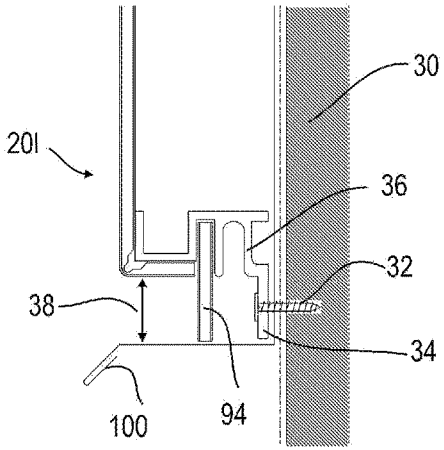
FIG. 16 is a cross sectional view of another example of the components shown in FIG. 3 also showing outer panels attached thereto on an end panel.

Looking to FIG. 16 is shown an example similar to that of FIG. 15 shown in this example at the bottom of a panel assembly 20*l* wherein the fastener(s) 32 simultaneously attaches the wall mounting extension 36 and the flashing 100 to the building surface 30. Again, an optional spline 94 may be utilized if desired to hide the fasteners 32 or for additional weather resistance.

Figure 17:
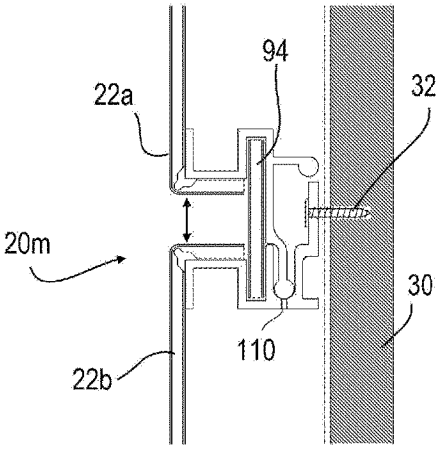
FIG. 17 is a cross sectional view of another example of the components shown in FIG. 3 also showing outer panels attached thereto with a horizontal gap 38 between vertically adjacent panels.

FIG. 17 shows a cross sectional view of another example showing outer panels attached thereto with a horizontal/vertical gap 38 between vertically/horizontally adjacent panels.

Figure 18:
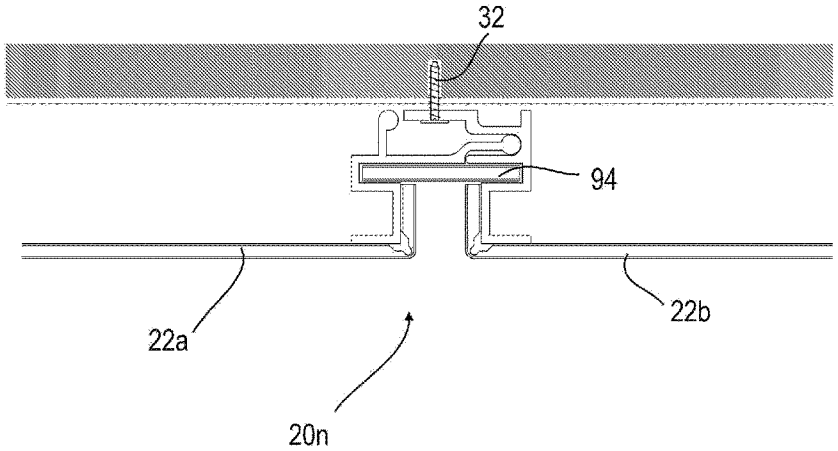
FIG. 18 is a cross sectional view of another example of the components shown in FIG. 3 also showing outer panels attached thereto with a vertical gap 38 between horizontally adjacent panels.
Figure 21:
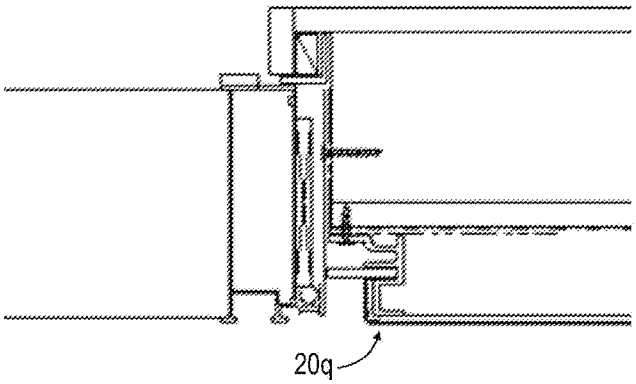
FIG. 21 is a cross sectional view of another installation of the components shown in FIG. 3.
Figure 23:
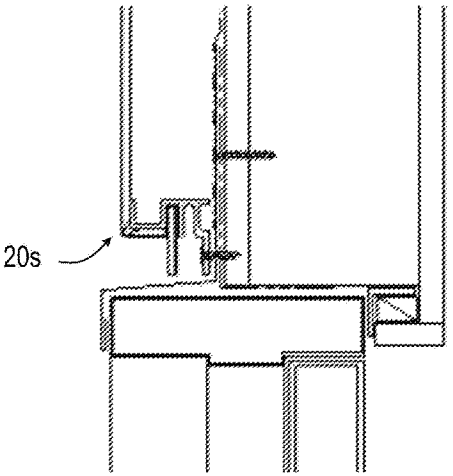
FIG. 23 is a cross sectional view of another installation of the components shown in FIG. 3.
Figure 20:
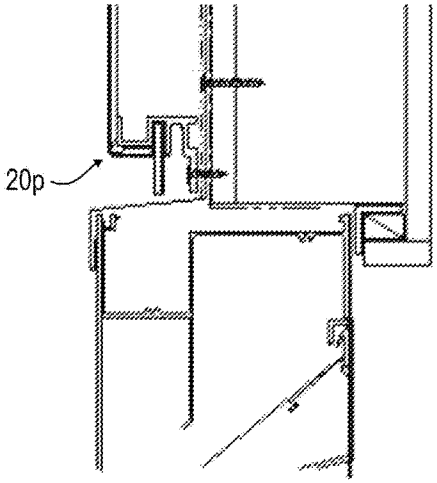
FIG. 20 is a cross sectional view of another installation of the components shown in FIG. 3.
Figure 22:
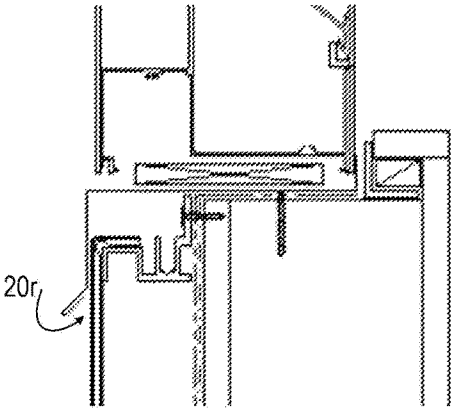
FIG. 22 is a cross sectional view of another installation of the components shown in FIG. 3.
Figure 24:
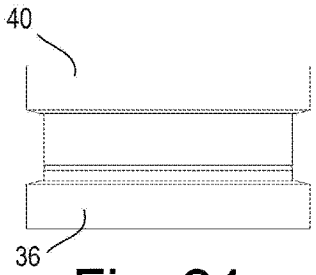
FIG. 24 is a top view of the components shown in FIG. 3.
Figure 25:
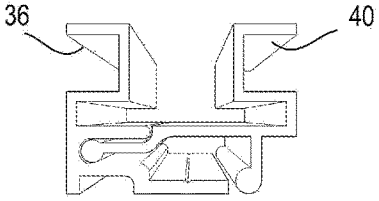
FIG. 25 is an isometric cutaway end view of a section of the components shown in FIG. 3 with the opposing end view being a mirror image thereof.
Figure 26:
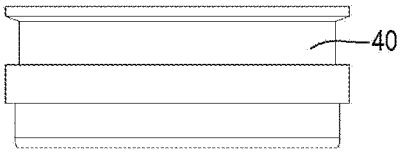
FIG. 26 is a front view of a section of the components shown in FIG. 3.
Figure 27:
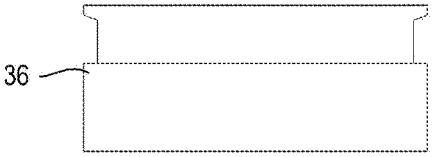
FIG. 27 is a rear view of a section of the components shown in FIG. 3.
Figure 28:
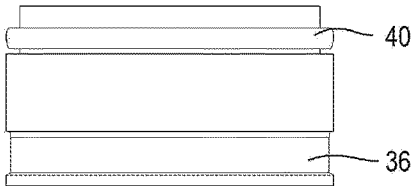
FIG. 28 is a bottom view of a section of the components shown in FIG. 3.
Figure 29:
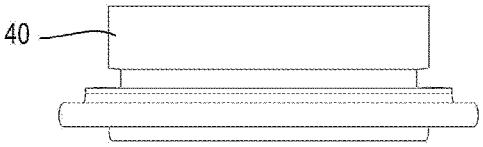
FIG. 29 is a rear view of a section of the component shown in FIG. 1.
Figure 30:
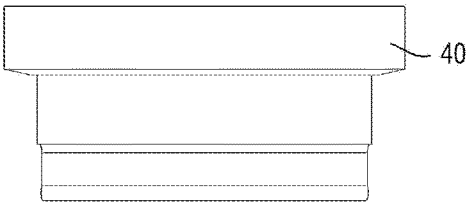
FIG. 30 is a top view of a section of the component shown in FIG. 1.
Figure 31:
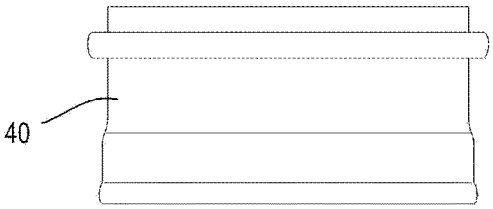
FIG. 31 is a bottom view of a section of the component shown in FIG. 1.
Figure 32:
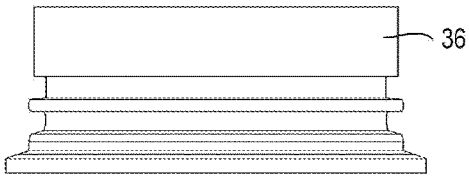
FIG. 32 is a front view of a section of the component shown in FIG. 2.
Figure 33:
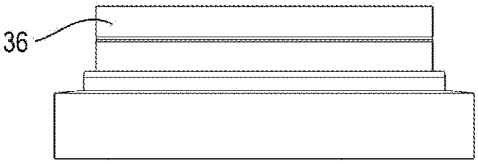
FIG. 33 is a top view of a section of the component shown in FIG. 2.

FIG. 18 shows a cross sectional view of another example showing outer panels attached thereto with a vertical gap 38 between horizontally adjacent panels.

Figure 19:
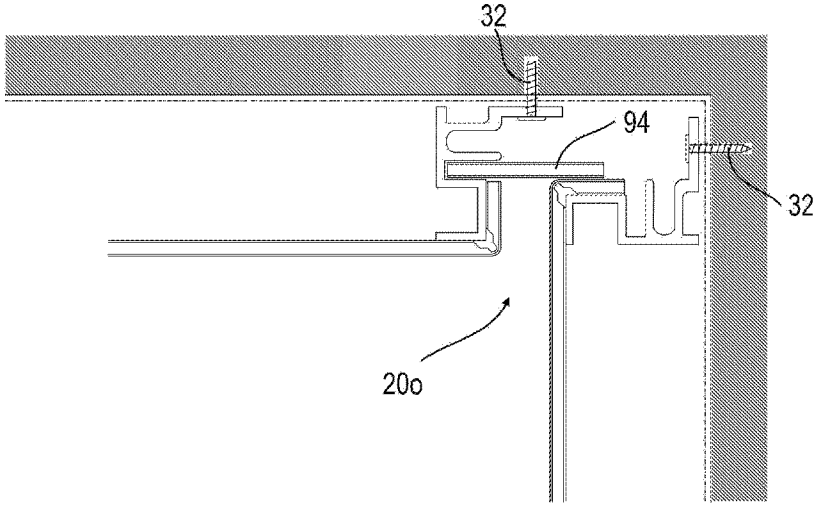
FIG. 19 is a cross sectional view of another example of the components shown in FIG. 3 also showing outer panels attached thereto to an inside corner where two adjacent outer panels face each other.

FIG. 19 shows a cross sectional view of another example showing outer panels attached to an inside corner of a building where two adjacent panels face each other. In this example, each of the panel assemblies 20*o* shown has a mounting extrusion 36 attached thereto.

During construction of a panel assembly 20 as shown for example in FIG. 7, it may be desired to bend the outer panel 22 to form a face panel 24*c* and side panels 26*c* and 28*c*. The face panel is generally then affixed to a frame of extrusions 36/40 by way of adhesive as disclosed in the '054 disclosure, upon which the individual frame components 36/40 are often (tack) welded, screwed, bolted, or otherwise fixed to each other and optionally to the outer panel 20*c*. The frame components 36/40 attached to the face panel 24 as described, often in one construction step where all frame components are simultaneously connected to each other and optionally to the face panel 24. The combination of the outer panel 20 and frame (extrusions 26/28) form a panel assembly 20. As these panel assemblies 20 are often custom fit to a particular installation, it is generally not convenient to provide the frames prior to construction within the outer panel 22. Once assembled, a panel assembly 20 may be attached to a building surface 30 generally by way of fasteners 32 passing through the mounting extrusion 36 or otherwise attached thereto.

Once the frame extrusions 36/40 are properly positioned relative to each other and the outer panel 22, (tack) welding, brazing, adhering or otherwise fixing independent frame extrusions 36/40 together may be required (such as at connecting surfaces).

In one example, the outer panel 22 and/or extrusions 36/40 are formed of an aluminum composite material with a polymer (polyurethane) core. In such an example, the overall assembly is light, especially when the fasteners of prior art installations are eliminated from the construction.

Once the panel assembly 20 is properly constructed, it may be shipped and attached to the building surface 30 as previously disclosed without additional modification. This eliminates troubles associated with custom fitting at the panel assemblies in the field.

The frame extrusions 36/40 may include surfaces defining a void through the extrusion forming at least one vent/weep conduit 110 as shown by way of one example in FIG. 17. These conduits allow for water passage through at least a portion of the frame extrusion 36/40. Generally, the outer face of the outer panel 22 is in a vertical plane when installed and it is less than desirable neither for water to accumulate either between the outer panel 22 and the building surface 30 nor within any portion of the frame extrusions 36/40. Thus such a conduit allows for water passage through the panel assembly 20 as the water enters one of the conduits in the upper or side frame extrusion components and then exits through a conduit in the lower or side frame extrusion components. In one form, such a weep channel may facilitate water conduction around the frame components.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. An architectural panel assembly comprising:

a first outer panel assembly comprising a first face panel, a plurality of side panels, a first frame member;

the first frame member having an extending portion parallel to the first face panel;

the extending portion configured to be mounted directly to a building surface;

the extending portion in direct contact with the building surface laterally outward from the first face panel so as to not be obstructed thereby;

the first frame member having a surface defining a lateral receiver;

a second outer panel assembly comprising a second face panel, a plurality of side panels, a second frame member; and the second frame member having a lateral protrusion configured to laterally engage and seal to the lateral receiver.

2. The panel assembly as recited in claim 1 wherein the lateral protrusion of the insert extrusion frame member has an expanded end thereon wherein the expanded forms a seal to the lateral receiver.

3. The panel assembly as recited in claim 1 wherein the second frame member comprises a transverse extension extending to contact but not affix to the building surface, the transverse extension in sliding engagement with the building surface during assembly as the lateral protrusion laterally engages the surface defining the lateral receiver in the second frame member of the second outer panel assembly.

4. The panel assembly as recited in claim 1 wherein the first frame member and the second frame member each comprise surfaces forming lateral spline receivers transversely offset from the building surface and the lateral protrusion.

5. The panel assembly as recited in claim 1 wherein the first frame member comprises a surface forming a lateral spline receiver transversely offset from the building surface.

6. The panel assembly as recited in claim 1 wherein the second frame member comprises a surface forming a lateral spline receiver transversely offset from the building surface.

* * * * *